US005311733A

United States Patent [19]

Krenkel

[11] Patent Number: 5,311,733

[45] Date of Patent: May 17, 1994

[54] COMBINATION GOLF BALL RETRIEVER AND TRAP RAKE

[75] Inventor: Edward G. Krenkel, Clarklake, Mich.

[73] Assignee: Michigan Business Consulting Services, Inc., Jackson, Mich.

[21] Appl. No.: 925,187

[22] Filed: Aug. 6, 1992

[51] Int. Cl.[5] ..... A01D 07/06

[52] U.S. Cl. ..... 56/400.06; 56/400.16; 56/400.2

[58] Field of Search ..... 56/400.04, 400.06, 400.16, 56/400.19, 400.2, 400.21

[56] References Cited

U.S. PATENT DOCUMENTS

| | | | |
|---|---|---|---|
| 1,601,745 | 10/1926 | Swineford et al. | 56/400.16 |
| 1,832,358 | 11/1931 | Bruck | 56/400.16 |
| 2,110,538 | 3/1938 | Walsh | 55/10 |
| 2,721,755 | 10/1955 | Walner | 294/19 |
| 2,738,214 | 3/1956 | Zimmers | 294/19 |
| 3,614,149 | 10/1971 | Clark | 294/19 A |
| 4,174,003 | 11/1979 | Zepeda | 56/400.06 X |
| 4,216,831 | 8/1980 | Ritchie | 172/380 |
| 4,774,804 | 10/1988 | Sands | 56/400.01 |

FOREIGN PATENT DOCUMENTS

| | | | |
|---|---|---|---|
| 780757 | 2/1935 | France | 56/400.2 |
| 138253 | 5/1930 | Switzerland | 56/400.16 |

*Primary Examiner*—Terry Lee Melius
*Attorney, Agent, or Firm*—Beaman & Beaman

[57] ABSTRACT

A golf ball retriever which can also be used as a trap rake. A head mounted upon an extendible handle includes a plurality of elongated spaced tines extending from pivoted arms. The arms are pivotal between a folded storage position and an extended open operative position and the tines are separated by a distance slightly less than the diameter of a golf ball whereby the retriever head may be "raked" through a water hazard to retrieve the balls. The rake-like orientation of the tines also permits the head to smooth sand traps.

3 Claims, 1 Drawing Sheet

COMBINATION GOLF BALL RETRIEVER AND TRAP RAKE

BACKGROUND OF THE INVENTION

1. Field of the Invention

The invention pertains to a combination golf ball retriever and trap rake which consists of a head having a plurality of tines supported thereon affixed to an extendible handle. The tines extend in both an upwardly and downwardly direction whereby the lower tines will engage submerged golf balls and balls upwardly deflected by the lower tines will be retained by the upper tines. The tines are mounted upon pivotally supported arms for folding to a storage or carrying position.

2. Description of the Related Art

Golf courses often include water hazards, and a number of golf ball retrievers have been developed for salvaging golf balls which find their way into a water hazard. Most golf ball retrievers are of the pocket type wherein a cup is mounted upon an extendible handle for encompassing the submerged ball. Such devices require visual observation of the ball, and in many instances the submerged ball is not visible and is unretrievable with this type of device.

Rake-like golf ball retrievers having a plurality of fingers or tines for retrieving non-observable balls are known such as shown in U.S. Pat. Nos. 2,721,755; 2,738,214; 4,216,831 and 4,774,804. However, such rake type retrievers have experienced limited success in that golf balls are partially buoyant, and when engaged by a rake the ball will often rise over the rake and escape retrieval. Pat. No. 4,774,804 discloses a rake having upper and lower serrations, but the configuration of the serrations are not sufficient to effectively retain submerged balls lifted by the retriever.

SUMMARY OF THE INVENTION

It is an object of the invention to provide a golf ball retriever of the rake type wherein the retriever includes both upper and lower tines wherein the upper tines will effectively retain a golf ball which has been lifted from its resting place by the lower tines.

Yet another object of the invention is to provide a rake type golf ball retriever which may also be used as a sand trap rake wherein the retriever utilizes upper and lower tines, and the tines are of such a configuration as to effectively hold the golf ball during retrieval, and minimize escape of the ball when engaged by the retriever.

Yet another object of the invention is to provide a rake type golf ball retriever utilizing a plurality of upper and lower tines and wherein the tines are mounted upon foldable arms pivotally mounted upon a handle such that the tine arms may be pivoted to a concise storing and handling configuration.

In the practice of the invention, a retriever head is mounted upon an extendible handle. The head consists of a pair of pivotally mounted arms which may be pivoted between a folded and carrying position substantially parallel to the length of the handle, or to an open extended position to define a rake type implement.

The head includes a plurality of cantilever supported tines extending in opposite directions from each associated pivoted arm as to constitute upper and lower extending tines. Adjacent tines are separated by a distance slightly less than the diameter of a golf ball, and the outer end regions of the tines are slightly deformed in the direction of the handle as to control the golf ball movement when engaged by the retriever. When the submerged ball is engaged by the outer regions of the lower tines, the ball will be lifted from its resting place and deflected upwardly due to the buoyancy of the golf ball. The upper tines will engage the lifted ball and retain the ball in the retriever as the retriever head is drawn toward the user and prevent the ball from escaping.

When the arms are extended, the lower tines may be effectively used to smooth the sand in a golf trap, and the construction of the retriever is economical, permits the retriever to be concisely folded to an inoperative storage position as to be readily carried within a conventional golf bag, and the tine carrying arms include abutments which limit pivotal movement of the arms to the open position wherein proper operation of the device requires minimal skills.

BRIEF DESCRIPTION OF THE DRAWINGS

The aforementioned objects and advantages of the invention will be appreciated from the following description and accompanying drawing wherein.

DESCRIPTION OF THE PREFERRED EMBODIMENT

Figure 1:
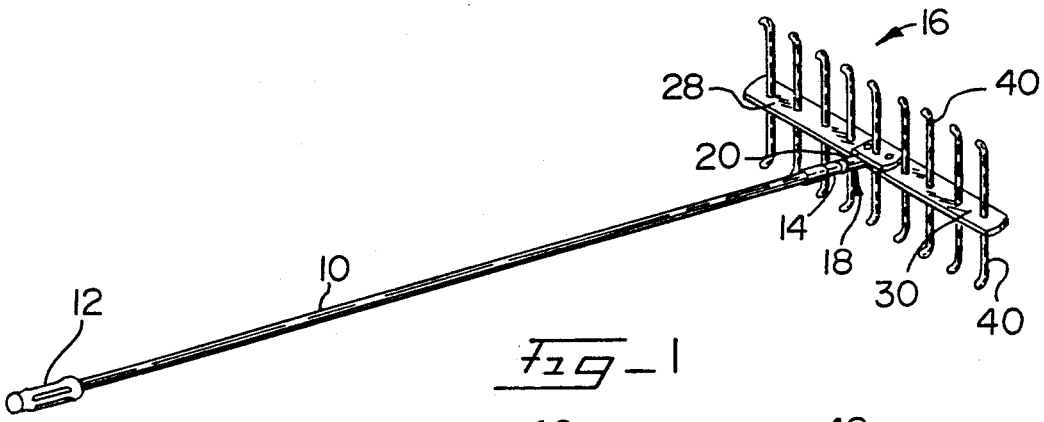
FIG. 1 is a perspective view of a golf ball retriever and sand rake in accord with the invention illustrating the head arms in the open position.

A golf ball retriever and trap rake in accord with the invention is illustrated in its entirety in FIG. 1. The handle is represented at 10, and preferably consists of a telescoping extendible handle of the conventional type well known as used with golf ball retrievers. The handle includes a hand grip 12, and an implement end 14 upon which the head 16 is mounted.

The head 16 includes a bracket generally indicated at 18 mounted upon the handle implement end 14 which includes cylindrical portions 20 which encompass the end 14 and are attached together by screws or the like, and each of these cylindrical portions 20 includes a flat plate 22, the plates 22 being in spaced opposed relationship to each other.

Pivot screws 24 extend between the plates 22 and receive nuts 26 at their outer ends. A tine arm 28 is mounted upon one of the screws 24, while the other tine arm 30 is mounted upon the other pivot screw, and the pivot screws 24 permit the arms 28 and 30 to be pivotally mounted between the plates 22 for pivotal positions illustrated in FIGS. 3 and 4.

The inner end 32 of each of the tine arms 28 and 30 includes a hole 34 for receiving the associated pivot screw 24, and the inner end of the arm 28 is provided with an abutment surface 36, while the tine arm 30 is provided with an abutment surface 38.

Each of the tine arms 28 and 30 is provided with holes for receiving the cylindrical tines 40. The tines 40 extend through the associated arm, the arms being formed of a planar plate material, and the tines may be welded or otherwise affixed to the associated arm to prevent rotation of the tines relative to the arm. The tines are preferably formed of a cylindrical wire, such as of approximately ¼ inch diameter, and each of the tines includes an outer region 42 which is of a generally arcuate deformed configuration extending in the direction of the handle 10, i.e. toward the user who will be grasping the hand grip 12. Each of the tines includes a radiused convex end 44.

A central tine 46 extends through the plates 22 through a hole 48 defined in the plates, and the tine 46 is also welded or otherwise affixed to the associated plates.

Figure 2:
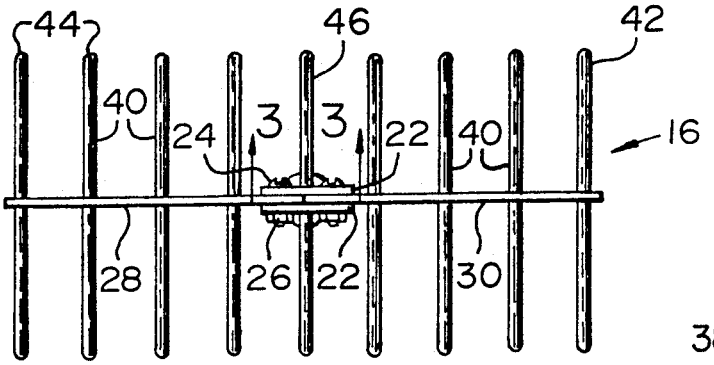
FIG. 2 is an end elevational view of the retriever head.
Figure 3:
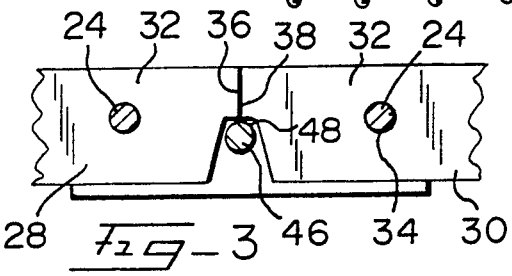
FIG. 3 is an enlarged sectional detail view taken along Section 3—3 of FIG. 2.

The pivotal support of the arms 28 and 30 upon the pivot screws 24 permits the arms to be pivoted to an open extended operative position as shown in FIGS. 1–3. In such an open position the arms 28 and 30 are in axial alignment, and the proper orientation of the arms is maintained by the engagement of the abutment surfaces 36 and 38 as shown in FIG. 3. In this open position the arms 28 and 30 define the head 16 which has a longitudinal length perpendicularly disposed to the length of the handle 10, and the retriever is in the form of a rake which is used in a normal rakelike manner.

With the arms 28 and 30 open as shown in FIGS. 1–3 the retriever is used in a rake-like manner and drawn through the submerged water hazard in which the lost ball resides. The lower tines 40 will engage the ball, and, in many cases, the lower tines will lift the ball from its resting place so that the ball will rise upwardly, and will be engaged by the upper tines 40. Golf balls have a specific gravity only slightly greater than that of water, and when engaged by a rake type receiver the balls tend to rise. However, the fact that the upper tines 40 extend a substantial distance above the associated arms 28 and 30 the lifted golf balls will engage the upper tines and be retained thereby as the spacing of adjacent tines is slightly less than the diameter of the golf ball. The arms 28 and 30 serve as a "captive" bar whereby golf balls located between the upper tines 40 will tend to rest on the arms as the head 16 is drawn toward the user. Experience will determine how fast the head 16 should be drawn toward the operator to most effectively retrieve the submerged golf ball.

Figure 4:
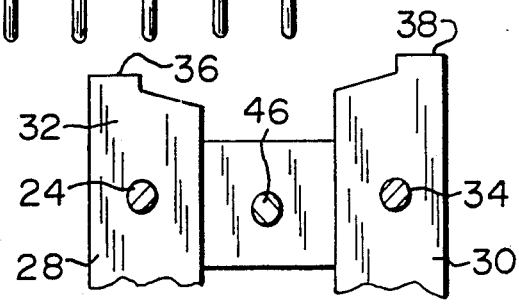
FIG. 4 is an enlarged detail sectional view similar to FIG. 3 illustrating the tine arms pivoted to the storage position.
Figure 5:
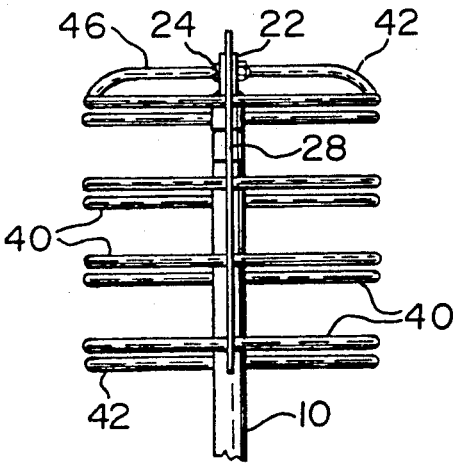
FIG. 5 is a detail side elevational view of the retriever head with the tine arms in the folded position.
Figure 6:
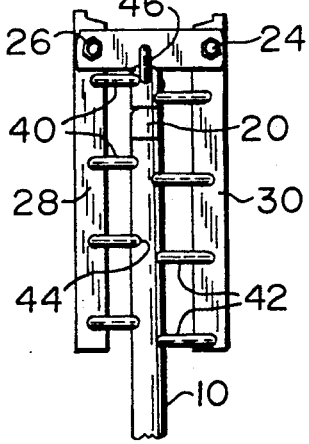
FIG. 6 is an elevational view similar to FIG. 5 as taken from the right thereof.

When the retriever is not in use, the handle 10 may be retracted to its minimum length, and the arms 28 and 30 folded to the position shown in FIGS. 4–6 wherein the length of the arms 28 and 30 is substantially parallel to the length of the handle 10. The arms will be located upon opposite sides of the handle 10, and the tines 40 in the arms 28 and 30 are slightly staggered with respect to each other as will be appreciated from FIGS. 5 and 6 so that the tines of the folded arms do not align and engage with each other when in the folded position permitting the head 16 to be concisely folded. The folded condition of the head 16 occupies only a little more space than a conventional golf club wood, and the retriever may be readily carried within a conventional golf bag supporting the golf clubs.

The retriever of the invention is capable of retrieving golf balls which are not observable while submerged, and is capable of retrieving balls which are resting adjacent weeds and other submerged obstacles. The retriever has been found to be very effective and often a plurality of golf balls are retrieved in a single drawing of the rake head toward the user.

It is appreciated that various modifications to the inventive concepts may be apparent to those skilled in the art without departing from the spirit and scope of the invention.

I claim:

1. A combination golf ball retriever and trap rake comprising, in combination, a handle having a holding end, an implement end and a longitudinal axis, an elongated head mounted on said handle implement end transversely disposed to said handle axis, said head having opposite sides, a plurality of elongated spaced tines mounted on said head extending from both of said head sides, said tines including free end regions, said end regions being angularly deformed in the direction toward said handle, adjacent tines being spaced apart a distance slightly less than the diameter of a golf ball whereby said tines will retain submerged golf balls upon drawing said head in the direction of said handle, said head including a bracket mounted upon said handle implement end, a pair of elongated arms pivotally mounted upon said bracket pivotal between a folded position disposing said arms substantially parallel to said handle axis and an extended open position wherein said arms are substantially axially aligned, said tines being mounted upon said arms, said arms each including an inner end located adjacent said bracket, an abutment surface defined upon each arm inner end, said abutment surfaces engaging upon said arms being pivoted to said open position to position and retain said arms at said open position, said tines on one of said arms being dimensionally staggered with respect to the tines on the other arm whereby said tines' free end regions of said respective arms are misaligned with respect to each other when said arms are pivoted to said folded position toward said handle.

2. In a golf ball retriever and trap rake as in claim 1, said tines being cylindrical in cross sectional configuration and having radiused convex free ends.

3. In a golf ball retriever and trap rake as in claim 1 wherein said arms are each of a flat plate construction, said tines transversely extending through the plane of the associated arm plate, said arms being of a width sufficient to capture and support golf balls engaging those tines extending in a generally upward direction, a central region defined on said bracket, and a tine extending through said bracket central region.

* * * * *